US005831505A

United States Patent [19]

Yamaguchi et al.

[11] Patent Number: 5,831,505

[45] Date of Patent: Nov. 3, 1998

[54] CHOKE COIL

[75] Inventors: Koichi Yamaguchi, Fukui-ken; Toshi Numata, Omihachiman, both of Japan

[73] Assignee: Murata Manufacturing Co., Ltd., Nagaokakyo, Japan

[21] Appl. No.: 921,594

[22] Filed: Sep. 2, 1997

[30] Foreign Application Priority Data

Sep. 2, 1996 [JP] Japan ..... 8-231722

[51] Int. Cl.[6] ..... H01F 27/02; H01F 27/24; H01F 27/30

[52] U.S. Cl. ..... 336/83; 336/212; 336/198; 336/233

[58] Field of Search ..... 336/83, 212, 233, 336/215, 198

[56] References Cited

U.S. PATENT DOCUMENTS

| | | | |
|---|---|---|---|
| 4,394,636 | 7/1983 | Hiraku et al. | 226/212 |
| 4,916,424 | 4/1990 | Kijima | 336/198 |
| 5,028,904 | 7/1991 | Kurano | 336/205 |
| 5,506,559 | 4/1996 | Yamaguchi | 336/83 |
| 5,629,661 | 5/1997 | Ooi et al. | 336/198 |

FOREIGN PATENT DOCUMENTS

| | | | |
|---|---|---|---|
| 6-132129 | 3/1992 | Japan | 336/212 |
| 7-106140 | 4/1995 | Japan | 336/178 |

*Primary Examiner*—Michael L. Gellner
*Assistant Examiner*—Anh Mai
*Attorney, Agent, or Firm*—Burns, Doane, Swecker & Mathis, LLP

[57] ABSTRACT

A choke coil equipped with a bobbin which is easy to form, which is resistant to mechanical impacts and which is light in weight and inexpensive. A bobbin 2 is formed, for example, by fitting or gluing together a bobbin member 21 formed of a magnetic substance and a bobbin member 22 formed of a non-magnetic substance. The magnetic substance bobbin member 21 is equipped with a core portion 23*a* with flange members 24*a* and 25*a* at the ends thereof and a flange member 26*a* provided in the central section thereof. The non-magnetic substance bobbin member 22 is equipped with a tubular portion 23*b* with flange members 24*b* and 25*b* provided at the ends thereof and a flange member 26*b* provided in the central section thereof. A tubular body portion 23 of the bobbin 2 is formed by the core portion 23*a* and the tubular portion 23*b*, and flange portions 24, 25 and 26 of the bobbin 2 are respectively formed by flange members 24*a*/24*b*, 25*a*/25*b* and 26*a*/26*b*.

15 Claims, 4 Drawing Sheets

CHOKE COIL

BACKGROUND OF THE INVENTION

1. Field of the Invention

The present invention relates to a choke coil and, in particular, to a choke coil which is used to eliminate noise generated by an electronic apparatus or the like and noise intruding on an electronic apparatus or the like.

2. Description of the Related Art

Generally speaking, a common mode choke coil has a small amount of leakage inductance component with respect to the differential mode, so that the common mode choke coil is effective in eliminating differential mode noise. When the differential mode noise is great, however, it is necessary to use, apart from the common mode choke coil, a differential mode choke coil to cope with the noise.

In the case of a common mode choke coil having a relatively large amount of leakage inductance component with respect to the differential mode, the leakage flux may adversely affect peripheral circuits. In such a case, it is necessary, for example, to provide a magnetic shield around the common mode choke coil.

In view of these concerns, Japanese Patent Laid-Open No. 7-106140 proposes a common mode choke coil which is capable of effectively eliminating both common mode noise and differential mode noise.

In the proposed common mode choke coil, however, the entire bobbin is formed of an expensive and heavy magnetic material, so that the choke coil is rather heavy and expensive.

Further, when the entire bobbin, which has a complicated configuration composed of a tubular body portion and a flange portion in the proposed common mode choke coil, is formed by injection molding or the like using a magnetic material, a sophisticated technique and a tight tolerances over manufacturing conditions are required. Further, the magnetic substance is relatively susceptible to mechanical impacts and liable to generate chips, cracks, etc. Thus, a magnetic material is rather difficult to handle when used in the formation of a bobbin, which has a complicated configuration.

SUMMARY OF THE INVENTION

It is an object of the present invention to provide a choke coil which is easy to form, which is resistant to mechanical impacts, and which is light in weight and inexpensive.

To achieve the above object, there is provided, in accordance with the present invention, a choke coil comprising:

(a) a non-magnetic substance bobbin member having a tubular portion and a flange member provided on the tubular portion;

(b) a magnetic substance bobbin member which forms a bobbin together with the above-mentioned non-magnetic substance bobbin member, and which has a core portion forming a body portion together with the above-mentioned tubular portion and a flange member provided on this core portion, and forming a flange portion together with the flange member of the above-mentioned non-magnetic substance bobbin member;

(c) a pair of windings wound around the body portion formed by the tubular portion and the core portion; and (d) a magnetic substance core one side of which is inserted into a hole of the tubular portion and which forms a closed magnetic circuit.

Further, in the choke coil of the present invention there is provided a magnetic substance cover which is joined to an end portion of the flange member of the above-mentioned magnetic substance bobbin member and which forms a closed magnetic circuit together with the above-mentioned magnetic substance bobbin member.

In this choke coil, constructed as described above, when a common mode noise current flows through the pair of windings, a magnetic flux is generated in each winding. These magnetic fluxes are added together. Then they are converted to heat energy by eddy current loss in the magnetic substance core forming a closed magnetic circuit and are attenuated, whereby the common mode noise current is eliminated.

When a differential mode noise current flows through the pair of coils, a magnetic flux is generated in the windings. This magnetic flux surrounds the closed magnetic circuit formed by the magnetic substance bobbin member and the magnetic substance cover, and is converted to heat energy by eddy current loss before it is attenuated, whereby the differential mode noise current is eliminated.

Since the bobbin is formed of a non-magnetic substance bobbin member, which is inexpensive and light in weight, and a magnetic substance bobbin member, which is expensive and heavy, the resulting bobbin it is less expensive and lighter than conventional bobbins.

Further, the non-magnetic substance bobbin member, which can be easily formed by injection molding or the like, has a complicated configuration having a tubular body portion and a flange member, whereas the magnetic substance bobbin member, which is rather difficult to form, has a simple configuration consisting of a core portion and a flange member, so that the bobbin can be easily produced. Further, since the non-magnetic substance bobbin member has a simple configuration, it is less liable than the prior art to generate chips, cracks, etc., whereby the handling of the bobbin is facilitated.

DETAILED DESCRIPTION OF THE PREFERRED EMBODIMENT

A choke coil according to an exemplary embodiment of the present invention will now be described with reference to the accompanying drawings.

Figure 1:
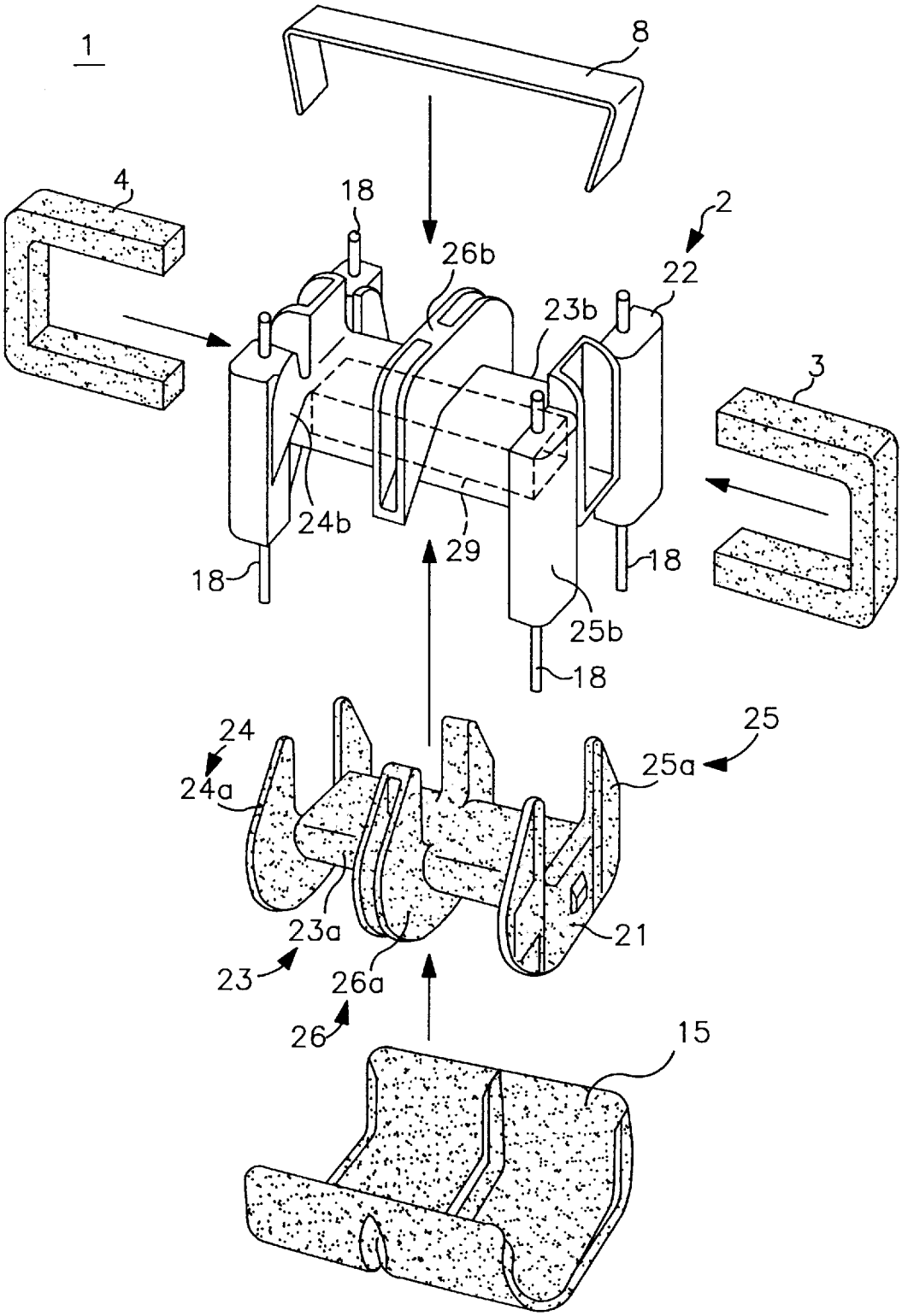
FIG. 1 is an exploded perspective view showing a choke coil in accordance with an embodiment of the present invention.
Figure 2:
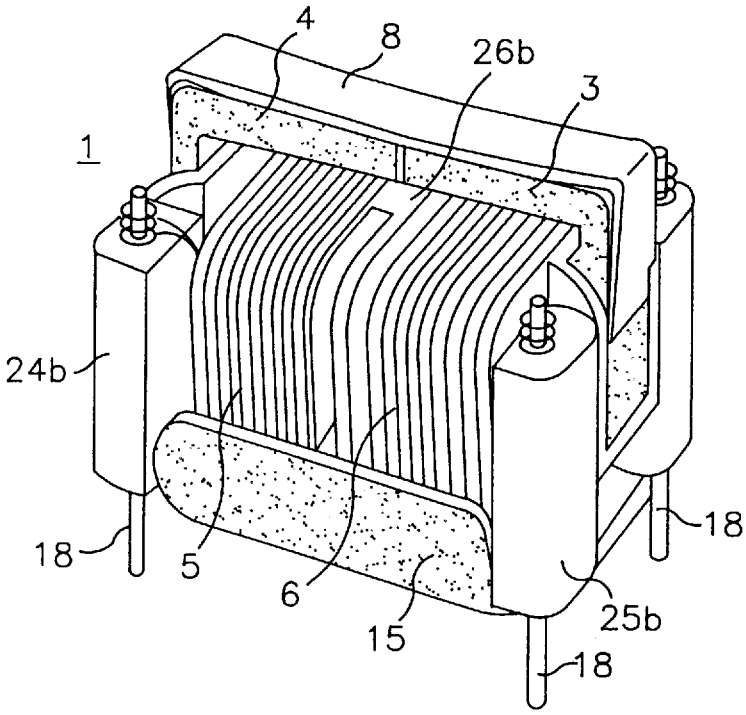
FIG. 2 is a perspective view showing the outward appearance of the choke coil shown in FIG. 1.

As shown in FIGS. 1 and 2, a choke coil 1 is generally composed of a bobbin 2, magnetic substance cores 3 and 4, a pair of windings 5 and 6, and a magnetic substance cover 15. The bobbin 2 is roughly divided along a plane parallel to the axis into two bobbin members 21 and 22. The magnetic substance bobbin member 21 is equipped with a core portion 23*a* with flange members 24*a* and 25*a* provided at the ends thereof and a flange member 26*a* provided in the central section thereof. The non-magnetic substance bobbin member 22 is equipped with a tubular portion 23*b* and flange members 24*b*, 25*b* and 26*b* provided at the ends and in the central section of its tubular portion 23*b*. Pin terminals 18 are embedded in the end flange members 24*b* and 25*b*. While it is preferable for the pin terminals 18 to be provided in the non-magnetic substance bobbin member 22, it is also possible for them to be provided in the magnetic substance bobbin member 21.

The magnetic substance bobbin member 21 and the magnetic substance cover 15 are formed of a magnetic material having a relative magnetic permeability of not less than 1 (for example, 2 to several tens). More specifically, for example, a material obtained by mixing an Ni—Zn-type or Mg—Zn-type ferrite powder with a resin binder can be used. The non-magnetic substance bobbin member 22 is formed of a non-magnetic material, for example, an insulating material. More specifically, polybutylene terephthalate resin, polyphenylene sulfide resin, polyethylene terephthalate resin, polyamide resin, or the like can be used. The magnetic substance cores 3 and 4, which have a U-shaped configuration, are preferably formed of a material having a relative magnetic permeability of several thousands. More specifically, ferrite, amorphous material or the like can be used.

The bobbin members 21 and 22, constructed as described above, are, for example, abutted, fitted or glued to each other to thereby form the bobbin 2. The bobbin 2 is not entirely formed of a magnetic substance material, which is expensive and heavy, so that a reduction can be achieved in terms of production cost and weight as compared with conventional bobbins.

By joining the bobbin members 21 and 22 to each other, the bobbin 2 is completed, which is equipped with a tubular body portion 23 consisting of body portions 23*a* and 23*b* and flange portions 24, 25 and 26 consisting of flange members 24*a*/24*b*, 25*a*/25*b* and 26*a*/26*b*. The tubular body portion 23 has a hole 29 having a rectangular cross section. The configuration of the cross section of the hole 29, however, is arbitrary. It is naturally also possible for the cross section to be round, for example.

As described above, the bobbin member 21, which is formed of a magnetic substance, has a simple structure having no such complicated section such as a tubular portion, so that the molding of the magnetic substance, which requires a sophisticated technique and strict control over manufacturing conditions, is facilitated. The die for producing the magnetic substance bobbin by molding is usually required to exhibit a higher level of wear resistance than that for molding resins, so that it is necessary to use a die which is made of a material that is expensive and hard to shape. The configuration of the bobbin member 21, however, is simple, so that the configuration of the die is also simple, whereby the cost for producing the die can also be reduced.

Further, due to the complicated configuration of the bobbin, burrs are liable to be generated in the opening of the hole of the tubular body portion, this section corresponding to the parting line of the die. If the entire bobbin is formed of a magnetic substance material as in the prior art, this burr must be removed since otherwise the magnetic characteristics of the choke coil would be deteriorated. In the case of the bobbin 2 of this embodiment of the present invention, in contrast, it is possible to select a resin of a satisfactory molding property, so that the opening of the tubular body portion 23 can be easily formed without involving the generation of burrs, and there is no concern that the magnetic characteristics of the choke coil will be deteriorated. Further, since the configuration of the magnetic substance bobbin member 21 is simple, cracks, chips, etc. are not easily generated, whereby the handling of the bobbin 2 is facilitated.

Next, the first ends of the windings 5 and 6 are respectively fixed to two pin terminals 18, and then the windings 5 and 6 are wound around the body portion 23. When the coil has been formed, the other ends of the windings 5 and 6 are respectively fixed and electrically connected to the remaining two pin terminals 18. Next, the outer peripheral surfaces of the flange members 24*a*, 25*a* and 26*a* of the bobbin member 21 are abutted to the curved recessed surface of the magnetic substance cover 15, and the bobbin member 21 and the magnetic substance cover 15 form a closed magnetic circuit. The outer peripheral surfaces of the flange members 24*a*, 25*a* and 26*a* of the bobbin member 21 and the magnetic substance cover 15 are joined together by an adhesive or the like.

When, for example, the influence of the leakage flux due to a differential mode noise current described below is not so large, it is not always necessary to provide the magnetic substance cover 15, due to the core portion 23*a* and the flange members 24*a*, 25*a* and 26*a* of the bobbin member 21.

One branch of each of the magnetic substance cores 3 and 4 is inserted into the hole 29 of the tubular body portion 23, and the branches are abutted against each other to thereby form a rectangular magnetic substance core. The magnetic substance cores 3 and 4 are fixed together by a fastening member 8, or fixed by adhesive, varnish or the like. In this way, the choke coil 1 is obtained.

Figure 3:
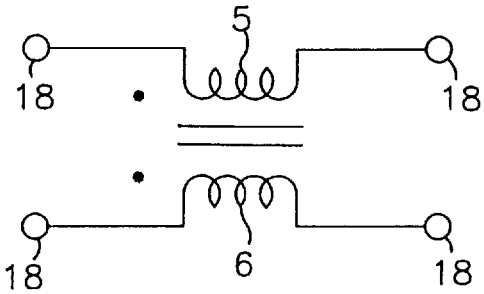
FIG. 3 is an electrical equivalent circuit diagram of the choke coil shown in FIG. 2.

FIG. 3 is an electrical equivalent circuit diagram of the choke coil 1.

The common mode noise eliminating operation of the choke coil 1, constructed as described above, will be described with reference to FIGS. 4(*a*) and 4(*b*).

Figure 4A:
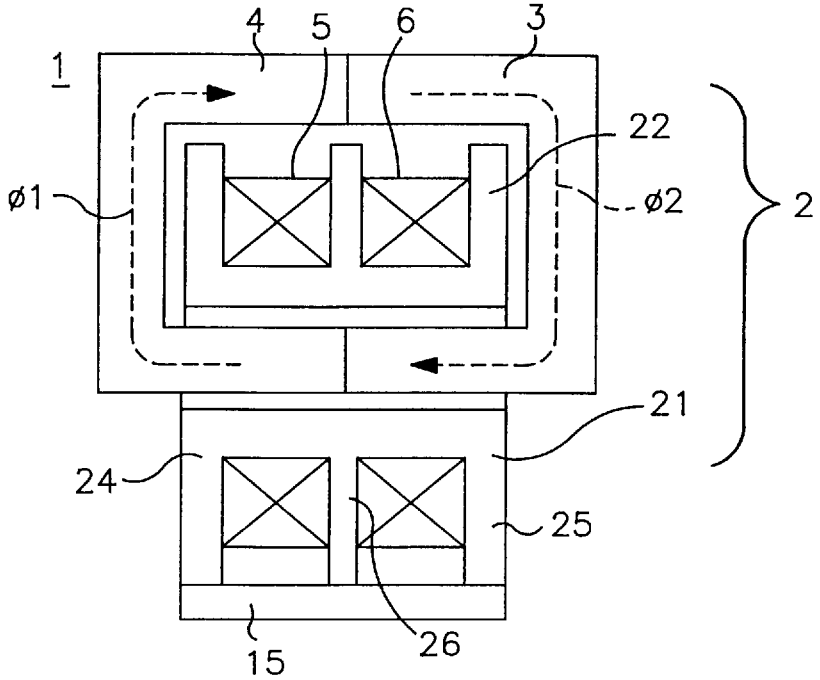
FIGS. 4(*a*) and 4(*b*) are diagrams showing how common mode noise is eliminated by the choke coil shown in FIG. 2, of which FIG. 4(*a*) is a magnetic circuit diagram, and FIG. 4(*b*) is an electric circuit diagram.
Figure 4B:
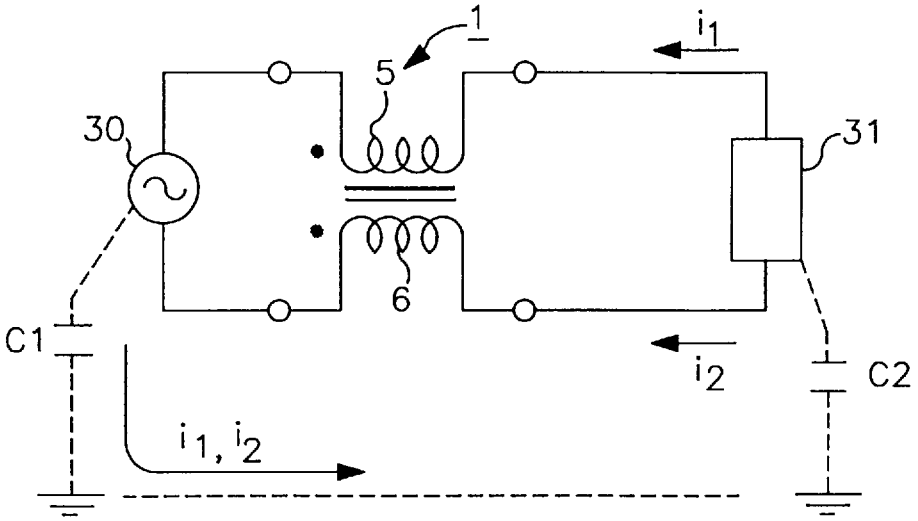

As shown in FIG. 4(*b*), the choke coil 1 is electrically connected to two signal lines arranged between a power source 30 and a load 31 consisting of an electronic apparatus or the like. Between the power source 30 and the ground, there is generated a floating capacitance C1, and, between the load 31 and the ground, there is generated a floating capacitance C2. When common mode noise currents $i_1$ and $i_2$ flow through the two signal lines in the directions indicated by the arrows in the diagram, magnetic fluxes ø1 and ø2 are generated in the windings 5 and 6. These magnetic fluxes ø1 and ø2 are added together and run around within the closed magnetic circuit of the magnetic substance cores 3 and 4, and are gradually attenuated since the magnetic fluxes ø1 and ø2 are converted to heat energy due to eddy current loss or the like, whereby the common mode noise currents $i_1$ and $i_2$ are reduced or eliminated.

Next, the differential mode noise eliminating operation of the choke coil 1 will be described with reference to FIGS. 5(*a*) and 5(*b*).

Figure 5A:
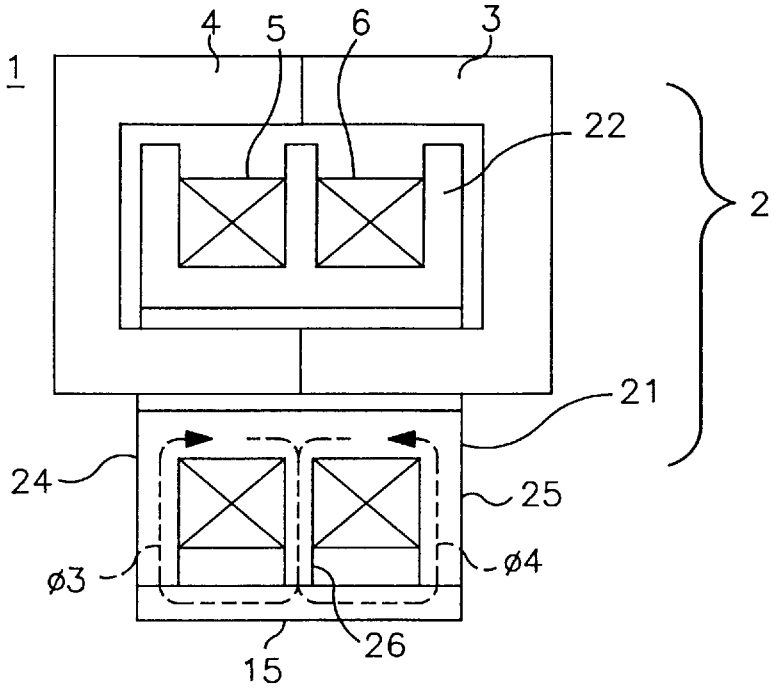
FIGS. 5(*a*) and 5(*b*) are diagrams showing how differential mode noise is eliminated by the choke coil shown in FIG. 2, of which FIG. 5(*a*) is a magnetic circuit diagram, and FIG. 5(*b*) is an electric circuit diagram.
Figure 5B:
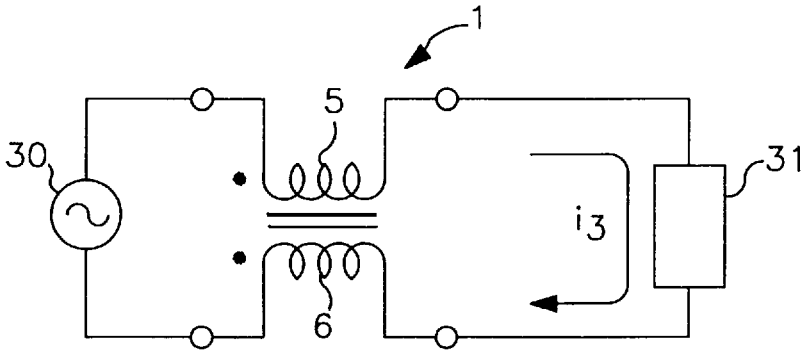

As shown in FIG. 5(*b*), when a differential mode noise current $i_3$ flows through the two signal lines in the direction indicated by the arrow in the diagram, magnetic fluxes ø3 and ø4 are generated in the windings 5 and 6. These magnetic fluxes ø3 and ø4 are converted to heat energy due to eddy current loss or the like as they run around within the closed magnetic circuit formed by the magnetic substance bobbin member 21 and the magnetic substance cover 15, and are gradually attenuated, whereby the differential mode noise current $i_3$ is reduced or eliminated.

The choke coil of the present invention is not restricted to the above-described exemplary embodiment. Various modifications are possible without departing from the scope of the invention. For example, an arbitrary choke coil configuration, etc. can be selected in accordance with the specifications.

As is apparent from the above description, in accordance with the present invention, the entire bobbin is not formed of a magnetic substance material, which is expensive and heavy, so that it is possible to achieve a reduction in production cost and weight as compared with the prior art.

Further, the bobbin member, formed of a magnetic substance, has a simple configuration having no such complicated portion such as a tubular portion, so that the molding of the magnetic substance, which requires a high level of technique and a strict control of manufacturing conditions, is facilitated. Further, due to the simple configuration of this magnetic substance bobbin member, cracks, chips, etc. are not easily generated.

What is claimed is:

1. A choke coil comprising:

a non-magnetic substance bobbin member having a tubular portion and a flange member provided on said tubular portion;

a magnetic substance bobbin member which forms a bobbin together with said non-magnetic substance bobbin member, and which has a core portion forming a body portion together with said tubular portion of said non-magnetic substance bobbin member, and a flange member provided on said core portion and forming a flange portion together with said flange portion of said non-magnetic substance bobbin member;

a pair of windings wound around the body portion formed by said tubular portion and said core portion; and a magnetic substance core one side of which is inserted into a hole of the tubular portion and which forms a closed magnetic circuit.

2. A choke coil according to claim 1, further comprising a magnetic substance cover which is joined to an end portion of the flange portion of said magnetic substance bobbin member and which forms a closed magnetic circuit together with said magnetic substance bobbin member.

3. A choke coil according to claim 2, wherein said magnetic substance cover has a relative magnetic permeability of not less than 1 and several tens.

4. A choke coil according to claim 1, wherein said non-magnetic substance bobbin member includes a central flange member and two end flange members.

5. A choke coil according to claim 4, wherein said non-magnetic substance bobbin member includes a central flange member and two end flange members, which form a central flange portions and two end flange portions together with said central flange member and two end flange members of said magnetic substance bobbin member, respectively.

6. A choke coil according to claim 4, further comprising pin terminals embedded in said end flange members of said non-magnetic substance bobbin member.

7. A choke coil according to claim 1, wherein said magnetic substance bobbin member includes a central flange member and two end flange members.

8. A choke coil according to claim 1, wherein said magnetic substance bobbin member has a relative magnetic permeability of not less than 1 and several tens.

9. A choke coil according to claim 1, wherein said magnetic substance bobbin member comprises a mixture of a power selected from the group consisting of an Ni—Zn-type ferrite powder and Mg—Zn-type ferrite powder, with a resin binder.

10. A choke coil according to claim 1, wherein said magnetic substance cover comprises a mixture of a power selected from the group consisting of an Ni—Zn-type ferrite powder and Mg—Zn-type ferrite powder, with a resin binder.

11. A choke coil according to claim 1, wherein said non-magnetic substance bobbin member comprises an insulating material.

12. A choke coil according to claim 1, wherein said non-magnetic substance bobbin member comprises a resin selected from the group consisting of: polybutylene terephthalate resin, polyphenylene sulfide resin, polyethylene terephthalate resin and polyamide resin.

13. A choke coil according to claim 1, wherein said magnetic substance core comprises two U-shaped core members connected together.

14. A choke coil according to claim 1, wherein said magnetic substance core comprises a material having a relative magnetic permeability of several thousands.

15. A choke coil according to claim 1, wherein said magnetic substance core comprises a material selected from the group consisting of ferrite and amorphous material.

* * * * *